US011753762B1

(12) United States Patent
Jackson

(10) Patent No.: US 11,753,762 B1
(45) Date of Patent: Sep. 12, 2023

(54) CONVERTIBLE TRELLIS CLOTHESLINE

(71) Applicant: Melbia L Jackson, Ridgeland, MS (US)

(72) Inventor: Melbia L Jackson, Ridgeland, MS (US)

( * ) Notice: Subject to any disclaimer, the term of this patent is extended or adjusted under 35 U.S.C. 154(b) by 0 days.

(21) Appl. No.: 17/658,766

(22) Filed: Apr. 11, 2022

(51) Int. Cl.
*D06F 53/02* (2006.01)
*D06F 53/04* (2006.01)
*A47B 61/02* (2006.01)

(52) U.S. Cl.
CPC ..... *D06F 53/02* (2013.01); *A47B 61/02* (2013.01); *D06F 53/045* (2013.01)

(58) Field of Classification Search
CPC ..... D06F 53/02; D06F 53/045; D06F 53/00; D06F 53/04; D06F 57/06; D06F 57/08; D06F 57/12; A47B 61/02; A47B 61/003; A47B 61/06; A47B 46/00; A47B 46/005; A47B 45/00; A47B 43/00
USPC ..... 211/165, 171, 119.16, 1.3, 119.01; 108/134, 135, 48, 152; 312/314
See application file for complete search history.

(56) References Cited

U.S. PATENT DOCUMENTS 253,081 A * 1/1882 McKenzie ..... A47G 25/0685 211/104
768,683 A * 8/1904 Parkhurst ..... A47B 61/06 190/13 C
842,821 A * 1/1907 Tryon ..... A47B 45/00 312/317.2
859,860 A * 7/1907 Weir ..... A47B 61/02 211/94.01
881,784 A * 3/1908 Fitts ..... D06F 57/12 211/119.16
920,352 A * 5/1909 Leavy ..... A47B 46/005 312/266
978,436 A * 12/1910 Davis ..... A47B 61/06 190/13 C
1,060,927 A * 5/1913 Meyer ..... A47B 61/02 211/94.02
1,260,163 A * 3/1918 Downie ..... A47F 5/13 211/104
1,300,444 A * 4/1919 Meyers ..... A47B 61/02 312/200
1,322,901 A * 11/1919 Heinlein, Sr. ..... A47B 61/06 312/351
1,340,565 A * 5/1920 Seidenburg ..... A47B 61/06 312/200

(Continued)

FOREIGN PATENT DOCUMENTS

DE 20214002651 U1 6/2014

OTHER PUBLICATIONS

Hills Portable 120 Folding Clothesline, https://www.theclotheslinestore.com.au/hills-portable-120-folding-clothesline/ Jun. 7, 2021.

(Continued)

*Primary Examiner* — Jennifer E. Novosad
(74) *Attorney, Agent, or Firm* — McAughan Deaver PLLC

(57) ABSTRACT

A clothesline that folds, collapses, and converts into a decorative trellis when the clothesline is not being used as a conventional outdoor clothesline to dry clothes or air freshen items. The decorative clothesline trellis may be wall-mounted such that when fully collapsed, the clothesline presents as a wall-mounted decorative trellis of various and possibly interchangeable decorative styles.

20 Claims, 6 Drawing Sheets

(56) References Cited

U.S. PATENT DOCUMENTS 1,373,189 A * 3/1921 Goldsmith ..... A47B 61/06 312/321
1,415,169 A * 5/1922 Gilbert ..... A47B 61/06 190/13 D
1,597,888 A * 8/1926 House ..... A47B 61/06 211/104
1,724,218 A * 8/1929 Nixon ..... D06F 57/12 211/98
2,061,499 A 11/1936 Frank
2,142,830 A * 1/1939 Wendell ..... A47B 61/02 211/100
2,268,894 A * 1/1942 Ogren ..... A47B 61/02 211/100
2,305,629 A * 12/1942 Magnuson ..... A47B 43/00 211/195
2,312,803 A * 3/1943 Curtenius ..... D06F 53/04 211/119.17
2,316,433 A * 4/1943 Hulick ..... D06F 57/12 211/104
2,419,226 A 4/1947 Palmer
2,434,891 A * 1/1948 Swanson ..... D06F 57/12 211/100
2,436,477 A * 2/1948 Lewis ..... D06F 53/04 211/119.15
2,473,047 A * 6/1949 Bershad ..... D06F 57/12 190/11
2,562,982 A * 8/1951 Cieri ..... A47L 19/04 211/41.6
2,702,734 A * 2/1955 Kroll ..... A47B 61/02 312/130
2,754,010 A * 7/1956 Griffith ..... D06F 57/12 211/97
2,875,903 A * 3/1959 Shourds ..... A47B 61/02 211/100
2,884,138 A * 4/1959 Leo ..... D06F 57/12 211/95
2,885,086 A * 5/1959 Lawrence ..... A47K 10/10 312/310
2,968,520 A * 1/1961 Abrens ..... A47G 25/0678 312/246
3,136,386 A * 6/1964 Jung ..... A47B 83/00 D25/63
3,380,429 A * 4/1968 Moinicken ..... E01F 13/02 116/63 P
3,612,284 A * 10/1971 Stoltz ..... D06F 57/12 211/105
4,155,609 A * 5/1979 Skafte ..... B25H 1/12 D6/555
4,225,048 A 9/1980 Hildreth
4,261,469 A 4/1981 Stone
4,326,637 A * 4/1982 James ..... A47F 5/10 211/175
4,550,840 A 11/1985 Van Deursen
4,632,255 A * 12/1986 Kennedy ..... A47G 25/0685 211/100
4,684,076 A 8/1987 Stamper
4,732,285 A 3/1988 Wuster
5,170,719 A * 12/1992 Pestone ..... A47B 5/04 211/104
5,372,266 A 12/1994 Fisher
5,375,534 A * 12/1994 Adams ..... B62D 33/042 211/1.3
5,408,936 A * 4/1995 Tseng ..... A47B 5/06 108/134
5,449,075 A 9/1995 Meade et al.
5,711,437 A * 1/1998 Flickinger ..... D06F 57/12 211/119.01
5,865,517 A * 2/1999 Wang ..... A47B 61/02 211/175
6,119,879 A * 9/2000 Acchione ..... A47B 77/10 211/171
6,149,020 A 11/2000 Gumpel et al.
6,308,843 B1 * 10/2001 De Boer ..... D06F 53/04 211/104
6,398,323 B1 * 6/2002 Lee ..... A47B 61/02 312/321
7,063,220 B2 6/2006 Jackson
7,273,154 B1 * 9/2007 Edwards ..... D06F 53/045 211/195
7,717,391 B2 * 5/2010 Roberts ..... D06F 57/08 248/353
7,806,280 B1 * 10/2010 Perkins ..... A47G 25/0685 211/100
7,832,574 B1 11/2010 Sexton
8,342,342 B1 1/2013 Vandelaar
8,573,417 B1 11/2013 Anderson
8,602,229 B2 12/2013 Raghunathan et al.
8,783,473 B1 * 7/2014 Schosek ..... A47G 25/0664 211/198
8,985,344 B2 * 3/2015 Larson ..... B62H 3/12 211/1.51
8,991,948 B2 * 3/2015 Marsters ..... A47B 46/005 312/301
9,051,680 B1 * 6/2015 Harris ..... D06F 57/12
9,096,968 B1 8/2015 Munoz
9,132,867 B1 9/2015 Klesow
9,167,895 B2 * 10/2015 Couch ..... A47B 46/005
9,308,974 B1 4/2016 Randall et al.
D762,877 S 8/2016 Charette
9,402,493 B2 * 8/2016 McAmis ..... A47G 25/0664
9,622,597 B2 * 4/2017 White ..... A47F 5/0006
9,883,741 B2 * 2/2018 Demasi, III ..... A47B 46/005
10,111,519 B2 * 10/2018 Rassam ..... A47B 1/02
10,111,543 B2 10/2018 Terragni et al.
D839,643 S 2/2019 De Jesus
D841,921 S 2/2019 De Jesus
10,201,229 B2 2/2019 Lambracht
10,506,877 B1 * 12/2019 Edwards, II ..... A47B 61/04
10,583,769 B2 3/2020 Tyler
D892,421 S 8/2020 Smith
2004/0070318 A1 * 4/2004 Shai ..... A47B 61/06 312/205
2005/0076530 A1 * 4/2005 Kresser ..... F26B 25/18 34/91
2006/0119237 A1 * 6/2006 Packer ..... A47B 46/005 312/313
2007/0034656 A1 2/2007 Davis
2008/0185358 A1 * 8/2008 Hernandez ..... D06F 57/12 211/195
2014/0027225 A1 * 1/2014 Richards ..... A45C 13/03 190/13 R
2014/0109433 A1 * 4/2014 Moore ..... D06F 57/08 211/1.3
2015/0176898 A1 * 6/2015 Simmon ..... F26B 9/10 34/239
2016/0213111 A1 * 7/2016 Aiello ..... A47B 61/00

OTHER PUBLICATIONS

Alberto Clotheshorse—Casamania, https:/www.madeindesign.co.uk/prod-alberto-clotheshorse-casamania-refcm8890-pcvi.html, Apr. 10, 2021.

Mother Earth News, Multi-Purpose Garden Trellis Plans—DIY, https:/www.pinterest.com/pin/562035228477740217/, at least as early as Apr. 11, 2022.

Mother Earth News, Multi-Purpose Garden Trellis Plans—DIY , https://pin.it/2M5PnGA, Apr. 16, 2022.

Freudenthal Manufacturing, Free standing, moveable Clotheslines, http:/www.freudenthalmfg.com/misc/clotheslines.php, Jun. 7, 2021.

clotheslines.com, Custom Decorative Clothesline Poles, https://www.clotheslines.com/wall-mounted-drying-racks, at least as early as Apr. 11, 2022.

Cottage Craft Works, Folding Umbrella Wall Clothes Drying Rack, | Amish Made USA, https://www.cottagecraftworks.com/folding-umbrella-wall-clothes-drying-rack-amish-made-usa, Jun. 7, 2021.

(56) References Cited

OTHER PUBLICATIONS

Air Dry 2400 Clothesline Ground Mounted—Made to Order. https://www.theclotheslinestore.com.au/air-dry-2400-clothesline-ground-mounted-made-to-order/, Jun. 7, 2021.

* cited by examiner

CONVERTIBLE TRELLIS CLOTHESLINE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

FIELD OF THE INVENTION

The present inventions are directed to convertible, deployable or stowable clotheslines for airing or drying articles, such as, but not limited to, articles of clothing.

DESCRIPTION OF THE RELATED ART

Many people seek to reduce their carbon footprint. Since a household clothes dryer consumes a significant amount of energy and produces large amounts of expelled waste heat, many people look to air dry their washed laundry. However, some neighborhoods have deed restrictions or rules that prohibit permanent clotheslines. Additionally, permanent clotheslines may reduce the usable space around a home.

Traditionally, clothe drying structures have been made from lines of rope strung between stationary poles each topped with a horizontal bar (each resembling a "T" shape) and are most frequently referred to as permanent clotheslines.

Previous attempts at making clothesline structures removable or temporarily relocatable have not been entirely successful. One such attempt has been to make the poles removable from the ground. The act of physically removing and inserting a pole directly into the ground requires a great deal of strength and/or the use of additional tools. This effort is compounded by the fact that the clothesline must have tension on the lines, so they don't sag thereby allowing the articles hanging on them to touch the ground.

Other attempts have been made to create movable or temporary clothes hanging structures. In some of these, materials were chosen that were lightweight and consequently not sufficiently resistant to the conditions of being left outside for extended periods. Several attempts have been made in the past to provide means for conveniently hanging clothes outside during laundry procedures with the intent of removing or relocating the clothesline structures.

U.S. Pat. No. 7,806,280 to Perkins, et al., entitled "Portable Clothes Hanging Rod," discloses "[a] deployable rod for hanging clothes after removal from a dryer. The apparatus is a circular rod with a hinge mechanism that is attached to a vertical wall surface. In a retracted state, it folds compactly up against the wall. In a deployed state, it extends perpendicularly outward. The apparatus is supported in the extended outward position by a cable that extends from the outer end back to the wall surface at a 45° angle. This cable support system provides strength for holding clothes. A user could remove clothes from a dryer, immediately place them on hangers and then hang them from the employed apparatus in the extended position; however, other articles may be supported in this manner."

U.S. Pat. No. 9,402,493 to McAmis, entitled "Heavy duty retractable mounted multi-purpose drying station," discloses "[a]multi-purpose retractable drying station comprises a mounting bracket and an elongate main support beam extending from the mounting bracket, the elongate main support beam having a mounting pin that projects through the mounting bracket, the position of the mounting pin in said slots determining a position of the elongate main support beam. The station also comprises a plurality of transverse rods, parallel and spaced apart along the elongate main support beam and mounted thereto, and each transverse rod including a bar serving as a rack for drying articles thereon, the elongate main support beam retracting from a deployed horizontal position to a stowed vertical position."

U.S. Pat. No. 6,308,843 to De Boer, entitled "Foldable clothes-lines," discloses "[a] foldable clothes-line having a pair of arms together with mounting brackets for fixing to supports. The arms comprise base sections which in use of the clothes-line engage in the brackets and line is carriage sections disposed at right angles to the base sections. The arms are pivotal in the brackets in a substantially horizontal plane between a first position at which the line carriage sections extend outwardly to deploy the clothes-line for service and a second folded position whereby the line carriage sections are located closely adjacent to the supports in a space saving configuration. The mounting brackets have a retaining mechanism to releasably hold the line carriage sections in the outwardly extended position."

U.S. Pat. No. 5,711,437 to Flickinger, entitled "Swinging Frame Clothesline," discloses "[a] swinging-frame clothesline having a frame sized, shaped and structured to support clotheslines between opposite sides of the frame. The frame has an attachment side that is attached pivotally to a fence and a support side that hangs down vertically when not being used. The frame is supportable with support legs that pivot vertically to a selectively upright attitude under the frame to position the frame in a selectively horizontal attitude for use mode. The support legs are pivotal to an attitude selectively parallel to the frame to allow the frame to pivot vertically downward to a non-use mode. Support braces can be suspended between opposite sides of the frame to which clotheslines are attached."

U.S. Pat. No. 2,884,138 to Angelo, entitled "Swinging Clothesline," discloses "[a] movable clothes line assembly adapted to be mounted on the side of a building, comprising a main support arm, a horizontal L-shaped bracket, means for movably engaging said arm on said bracket, a bias spring connected between said L-shaped bracket and said arm for controlling the position of said arm on said bracket, an angle arm interconnected with said main arm for supporting said main arm, a clothes line assembly having weather vanes, a vertical stem, means for mounting said vertical stem on said arm, means for rotatably mounting said clothes line assembly on said stem, is and a rope means for pulling said main arm against the bias of the said spring, whereby said clothes line assembly may be moved proximate the end of said L-shaped bracket."

U.S. Pat. No. 7,273,154 to Edwards, entitled "Portable Clothesline Assembly for Vehicles," discloses "[a]n assembly includes a housing that has a tubular shape provided with opposed open ends, a planar top surface with spaced apertures adjacent to the ends thereof, and is formed from durable and non-corrosive material. Couplings are insertable into the open ends and are adaptable along a longitudinal axis of the housing. Each coupling has a core provided with a linear bore formed at an angle offset from a vertical axis and a hole formed therein which is positional with an associated one of the apertures. Quick-release pins are insertable into corresponding ones of the apertures and holes, maintaining the couplings at a static relationship with the housing. Coextensive support shafts are interfittable into the bores after the couplings are displaced from the housing. A flexible cord has opposed ends tethered to the support shafts so that the cord maintains a sufficient tension for supporting wet clothes therefrom."

U.S. Pat. No. 9,051,680 to Harris, entitled "Retractable clothesline support and method," discloses "[a] retractable clothesline support and method utilizes a pivotable arm hingedly attached to a housing. The arm having a reel with a line such as a clothesline wound thereon can be unlocked and then unreeled. The line support is particularly useful with an RV or other mobile vehicle while traveling for hanging wet clothes or the like for drying purposes. When not in use the clothesline can be wound on the reel, the reel locked and the arm closed for containment within the housing."

U.S. Pat. No. 8,783,473 to Schosek, entitled "Folding Clothes Rack," discloses "[a] triangular folding clothes rack having a top tubular cross piece with an inner axle to allow a front frame of the rack and a rear frame of the rack to fold outward into an open position for drying is articles of clothing and inward into a closed position for storing the rack. Clothes may be hung from the top tubular piece and/or hanging rods either directly and/or by using conventional hangers. Offsets located on the rear frame and extensions located on hanging rods allow clothes to be hung without the clothes lying on top of each other, thereby providing maximum airflow between the clothes to allow for expedited drying."

U.S. Pat. No. 7,717,391 to Roberts, entitled "Portable Clothes Stand," discloses: "[a] clothes line with a central frame member. Outwardly extending end members supporting clothes line therebetween, and legs at each end of the member which are supported to be foldable, between a position where they lie alongside the member to a position providing support for the member.

The present inventions are directed to deployable clotheslines that present a decorative facade when not in use for drying or airing clothes or other materials.

BRIEF SUMMARY OF THE INVENTION

A brief, non-limiting summary of one of the many possible embodiments of the present invention is a decorative outdoor assembly that deploys into a clothes drying structure, in which the assembly may comprise a deployable panel comprising a first end and a second end with a first length between the ends, wherein the second end may be rotatably affixed to a first end of a rail; the rail having a first end and a second end, and wherein the second end may be configured to rotatably connect to an anchor; the anchor may comprise an axis of rotation positioned substantially at the first length above the ground; wherein a closed configuration may comprise the ends of the relocatable panel in a vertical position with the first end of the relocatable panel substantially adjacent the anchor and the second end of the relocatable panel adjacent the ground, is with the rail in a vertical position between the relocatable panel and the anchor; wherein an opened configuration may comprise the ends of the relocatable panel in a vertical position with the first end of the relocatable panel set apart from the anchor by the rail in a substantially horizontal position; and wherein at least one clothesline may be secured to the assembly and may be configured to have a length to span between the relocatable panel and the anchor when the assembly may be deployed in the opened configuration. The first end of the relocatable panel may be adjacent the ground in the open configuration. The second end of the relocatable panel may be adjacent the ground in the open configuration. The rail may further comprise at least one hinge between the first and second ends. The anchor may be secured to a freestanding vertical structure. The anchor may further comprise at least one vertical post. The vertical panel may further comprise at least one face. A first end of the clothesline may be secured to the vertical panel. The second end of the clothesline may be secured adjacent the anchor. A brief, non-limiting summary of another of the many possible embodiments of the present invention is a retractable clothesline support in which a first support rotatably secured to a first end of a rail; a second end of the rail rotatably secured to a vertical panel; wherein the vertical panel may be movable from a first position separated from the first support by the rail in a substantially horizontal position to a second position where the vertical panel may be adjacent the first support and the rail may be in a substantially vertical position between the vertical panel and the support; and wherein at least one clothes hanging line spans the distance between the support and the vertical panel. The first support may comprise a first hinge that connects to a first end of the rail and has at least one lockable position; and the vertical panel may comprise a second hinge that connects to a second end of the rail and has at least one lockable position. The first support may be secured to a freestanding vertical structure. The first support may further comprise at least one vertical post. The rail may comprise a frame with outer edges, and wherein the at least one clothes hanging line may be secured to opposing edges. The rail may comprise jointed segments and wherein the jointed segments are configured to be linked together in a lockable position. The rail may further comprise at least one arm emanating away from a central axis.

A brief, non-limiting summary of yet another of the many possible embodiments of the present invention is a trellis that converts to a garment hanging system in which a first hinge may be configured to rotatably secure a frame to a stationary vertical support, the first hinge maybe oriented at a first distance above the ground; the frame may be configured to secure at least one article hanging line from a point proximal to the vertical support on the frame to a point on the opposite side of the frame from the vertical support; the frame further may be configured to be rotatably connected to a movable vertical support, where the movable vertical support has a height of substantially the first distance; the movable vertical support may be configured in a first position to be proximal to the stationary vertical support with the frame in a vertical position between the stationary vertical support and the movable stationary support, and may be configured to be moved to a second position where at least a portion of the frame has been rotated from the vertical position to a horizontal position. The stationary vertical support may be a wall or at least one post. The frame may comprise a jointed member. The frame may comprise a telescoping member.

None of these brief summaries of the inventions is intended to limit or otherwise affect the scope of the appended claims, and nothing stated in this Brief Summary of the Invention is intended as a definition of a claim term or phrase or as a disavowal or disclaimer of claim scope.

BRIEF DESCRIPTION OF THE SEVERAL VIEWS OF THE DRAWINGS

The following figures form part of the present specification and are included to demonstrate further certain aspects of the present invention. The invention may be better understood by reference to one or more of these figures in combination with the detailed description of certain embodiments presented herein.

Figure 1:
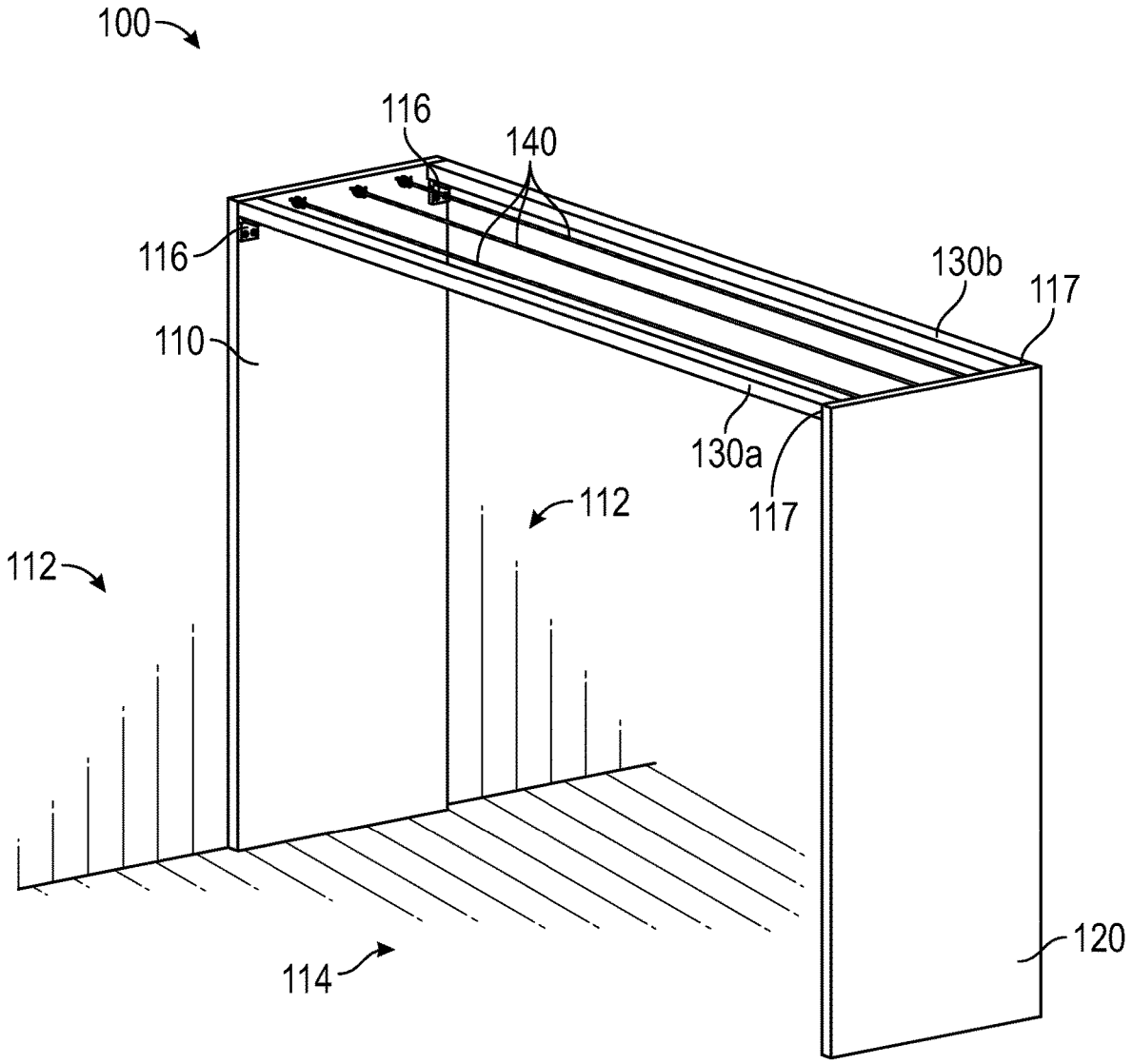
FIG. 1 illustrates a deployable trellis clothesline according to the present inventions in a fully extended configuration.

While the inventions disclosed herein are susceptible to various modifications and alternative forms, only a few specific embodiments have been shown by way of example in the is drawings and are described in more detail below. The figures and detailed descriptions of these embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts illustrated and taught by the specific embodiments.

DETAILED DESCRIPTION

The Figures described above, and the written description of specific structures and functions below, are not presented to limit the scope of what I have invented or the scope of the appended claims. Rather, the Figures and written description are provided to teach any person skilled in this art to make and use the inventions for which patent protection is sought.

A person of skill in this art having benefit of this disclosure will understand that the inventions are disclosed and taught herein by reference to specific embodiments, and that these specific embodiments are susceptible to numerous and various modifications and alternative forms without departing from the inventions we possess. For example, and not limitation, a person of skill in this art having benefit of this disclosure will understand that Figures and/or embodiments that use one or more common structures or elements, such as a structure or an element identified by a common reference number, are linked together for all purposes of supporting and enabling our inventions, and that such individual Figures or embodiments are not disparate disclosures. A person of skill in this art having benefit of this disclosure immediately will recognize and understand the various other embodiments of our inventions having one or more of the structures is or elements illustrated and/or described in the various linked embodiments. In other words, not all possible embodiments of our inventions are described or illustrated in this application, and one or more of the claims to our inventions may not be directed to a specific, disclosed example. Nonetheless, a person of skill in this art having benefit of this disclosure will understand that the claims are fully supported by the entirety of this disclosure.

Those persons skilled in this art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

Further, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the scope of what is claimed.

Reference throughout this disclosure to "one embodiment," "an embodiment," or similar language means that a particular feature, structure, or characteristic described in connection with is the embodiment is included in at least one of the many possible embodiments of the present inventions. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The description of elements in each Figure may refer to elements of proceeding Figures. Like numbers refer to like elements in all figures, including alternate embodiments of like elements. In some possible embodiments, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

It is an object of this invention to provide a convertible, deployable or stowable structure for hanging articles outdoors that folds and collapses when not in use. When not in use, the present inventions may convert into a decorative structure, such as a trellis, until needed again for drying or air freshening items. The decorative structure unfolds and opens, that is deploys, to become, for example, an outdoor clothesline.

The deployable structure may comprise a plurality of members or panels that are folded one upon another against a wall or other supporting structure and rotatably secured together. A deployable, outside panel may be a decorative trellis panel that serves as the outside support of the fully erected clothesline. In one of many embodiments, a middle panel may comprise a structure that supports the lines for hanging clothes and other articles. In one embodiment, an inside panel may be mounted against the wall to comprise the inside support of the clothesline. In another embodiment, the middle panel may simply attach to an anchor that allows for rotation at a location on a load-bearing structure such as the side of a house, a fence, or a baluster or stanchion.

The panels may be secured together in a vertical configuration, which will present the decorative outer, deployable panel, in a number of ways known to those ordinarily skilled in the art. In one of many embodiments, multi-directional locking hinges or other pivotable devices may allow for the folding and unfolding as well as stability of the trellis clothesline.

When the decorative wall-mounted trellis clothesline is fully folded, collapsed, and fastened in place, it presents a decorative wall mounted trellis. In one embodiment, the outer decorative panel may be removably secured to the other panels or directly to the load-bearing structure so that it remains upright and secured from falling down. Several mechanisms for removably securing the panels together and with the load-bearing structure are known to those of ordinary skill in the art and may include, but are not limited to, fasteners such as magnets, locking hasps or clasps, tethers, lockable hinges, and other mechanisms.

When the fasteners are released, the outer trellis panel may be pulled away and extended to lay flat or extend on a surface, such as the ground. Small handles or grips may be located at the joints connecting the outer trellis panel to the middle clothesline panel to provide an aid to lift the unit until the middle clothesline panel is in a relatively horizonal position and the outside trellis panel is in a relatively vertical position. In this embodiment, the inside wall-mounted panel always remains in a relatively vertical position. Locking hinges or other mechanisms may be engaged at the interconnection of each panel to stabilize the decorative trellis clothesline.

The individual clothes hanging lines in the middle section may be chosen to allow for the attachment of ordinary clothes pins to secure and suspend laundry and household items.

The trellis face may be of several different designs in order to appeal to different decor styles such as traditional, transitional, modern, contemporary, and farmhouse. In one of many embodiments, the trellis face may be replaceable so that an owner may place a seasonal trellis face on the panel. The various designs may be incorporated into the decorative trellis panel that serves as the outside support posts of the fully erected clothesline.

In other embodiments, any number of vertical supports may be utilized rather than having an inside panel secured to a wall for the support of the structure. Such embodiments may use a fence, one or more freestanding posts, balusters, stanchions, or a wall upon which a hinge, anchor, or other rotatable mechanism will provide support for the structure.

In another of many embodiments, a beam, pole, spar, or rail, or a plurality of beams, poles, spars, or rails, may be used instead of a middle panel. The beam, pole, spar, or rail will provide at least the same rigidity as the frame as previously described, and may include arms at each end, which may be used both for rotatably connecting to an adjoining panel and for securing the ends of the individual clothes hanging lines.

In another embodiment, the middle panel, pole, spar, or rail may comprise a plurality of members that they may be locked together to present a single panel, pole, spar, or rail with sufficient rigidity to support and tension the individual clothes hanging lines and to react any forces from the outer decorative panel so that the panel, pole, spar, or rail remains relatively horizontal when the structure is in its fully extended configuration.

Turning now to the Figures illustrating several particular, non-limiting, embodiments incorporating one or more aspects of the disclosed inventions, FIG. 1 illustrates the convertible trellis clothesline 100 in a fully extended or deployed configuration. In this embodiment, the first panel 110 of the convertible trellis clothesline 100 may be secured to a freestanding structure 112 such as a house, fence, or other structure that will keep the first panel 110 in a substantially upright position. The first panel 110 may be secured to the freestanding structure 112 such that the portion of the first panel 110 nearest the ground 114 is touching the ground 114. Alternatively, the portion of the first panel 110 nearest the ground 114 may be elevated so that it is not touching the ground 114.

The outwardly facing side of the first panel 110 may be a decorative face. FIG. 1 shows the reverse face of the first panel 110. This may be desirable when the convertible trellis clothesline 100 is in an open position and that face is visible. It may also be desirable if the outer panel 120 has decorative openings through it which allow portions of the first panel 110 to be seen through those openings.

The middle section of the convertible trellis clothesline 100 is comprised of beams 130*a*, 130*b* and the individual clothes hanging lines 140. The beams 130*a*, 130*b* connect to the first panel 110 and extend to and connect to the outer panel 120.

The mechanisms for connecting the beams 130*a*, 130*b* to the first panel 110 may include, but are not limited to simple hinges 116 and hinges that releasably lock at certain points of their rotation (not shown in this embodiment). Any of these mechanisms provide an anchor to secure an axis of rotation for the beams 130*a*, 130*b* so they may swing in an arc from below the anchor is to an angle substantially at the height of the anchor or just above that height relative to the stationary vertical surface 112. The outer panel 120 may be connected to the beams 130*a*, 130*b* using similar hinges.

In one embodiment, the convertible trellis clothesline 100 may have simple hinges between the beams 130*a*, 130*b* and the first panel 110 to provide an anchor. Similarly, the hinges connecting the beams 130*a*, 130*b* and the outer panel 120 may be simple hinges 117 that will need to rotate about 270°. In this embodiment, the hinges 117 connecting beams 130*a*, 130*b* and the outer panel 120 may be replaced with an axle arrangement or any other rotational mechanism as long as it permits a rotation of about 270°.

In this open configuration, the convertible trellis clothesline 100 has the first panel 110 secured to a stationary vertical surface 112 and connected via hinges 116 to the beams 130*a*, 130*b* that stretch and retain the clothes hanging lines 140. The beams 130*a*, 130*b* are also connected to the outer panel 120 with hinges 117, and the outer panel 120 is in a vertical orientation with the end that is not connected to the beams 130*a*, 130*b* in contact with the ground 114. Clothes hanging lines 140 may be secured to the first panel 110 and the outer panel 120, or they may be connected to stretchers (not shown in FIG. 1) that stretch between the beams 130*a*, 130*b*. Having stretchers near each end of the beams 130*a*, 130*b* (one stretcher near the first panel 110, and the other stretcher near the outer panel 120) may allow proper tensioning of the clothes hanging lines 140 without interfering with the rotation of the beams 130*a*, 130*b* in relation to the first panel 110 and the outer panel 120.

In this open configuration embodiment, the outer panel 120 may slide on the ground or be is disrupted from its vertical orientation. One of many ways to prevent this is to secure the outer panel 120 in a base (not shown in FIG. 1). Examples of a base that may be used to secure the outer panel 120 include but are not limited to: rocks; stakes in the ground; landscape timber; a pylon configured to receive an end of the outer panel 120; a furrow or trench configured to receive an end of the outer panel 120; or any other object or group of objects that will bolster the lower end of the outer panel 120. Additionally or alternately, the panel 120 may have one or more spikes or stakes on the end that contacts the ground to provide stabilization against unwanted movement relative to the ground.

In one envisioned embodiment, a method for securing the outer panel 120 to the ground when the convertible trellis clothesline 100 is in an open configuration may be to have spikes or pegs slidably attached to the end of the outer panel 120 that may be driven into the ground when that end of the outer panel 120 is contacting the ground. These spikes or pegs may be actuated by driving them with a hammer, a mallet, by force of foot, or spring actuated. As will be seen by those in possession of this disclosure the spikes or pegs may be used to retain the outer panel 120 in a vertical orientation when the convertible trellis clothesline 100 is in a closed configuration as described later.

If it is inopportune to have a furrow, trench, rocks, stakes, landscape timber or other objects in the location of securing the lower portion of the outer panel 120 when the convertible trellis clothesline 100 is in its open configuration, Applicant has devised other mechanisms to retain the outer panel 120 in a substantially vertical orientation. In one of many ways that will be known to those of ordinary skill in the art, locking hinges may be used in part of or in the entirety of the convertible trellis clothesline 100. Such hinges may be releasably locked at various orientations is that will provide the right angles needed to maintain the convertible trellis clothesline 100 in its open configuration.

Alternatively, other mechanisms may be used with ordinary hinges that have unimpeded swings. One such mechanism may be a retaining device secured to both a beam 130*a* and a side of the outer panel 120 that fixes them into an orientation of 90° to each other. Similarly, a dowel passing through the outer panel 120 and into a stretcher between the beams 130*a*, 130*b* may rigidly hold the outer panel 120 at an orientation of substantially 90° to the beams 130*a*, 130*b*. Those of ordinary skill in the art will be able to envision many other mechanisms to releasably hold the convertible trellis clothesline 100 in an open configuration without departing from the inventions disclosed and taught in this disclosure.

In an alternate configuration, those of ordinary skill in the art and in possession of this disclosure will understand that the first panel 110 may not be needed to practice the inventions disclosed herein. Instead, the hinges 116 may be directly secured to the stationary vertical surface 112 or to a piece attached to the stationary vertical surface 112. As noted, however, the first panel 110 may be decorative and preferable to seeing the surface of the stationary vertical surface 112.

Alternatively, the first panel 110 may be replaced with vertical members such as, but not limited to, free-standing posts, stanchions, or balusters to which hinges 116 may be secured. Similar to the length of the first panel 110, the vertical members need not extend to the ground, but need only be of sufficient height to provide an anchor with an axis of rotation at a height such that when the convertible trellis clothesline 100 is in its open configuration, the beams 130*a*, 130*b* will be substantially horizontal. Similarly, the vertical members such as a post need not stop at a height to secure the anchors, which are represented as hinges 116 in FIG. 1, to meet that criterion, is but may extend vertically further for esthetic, architectural or structural needs.

Figure 2:
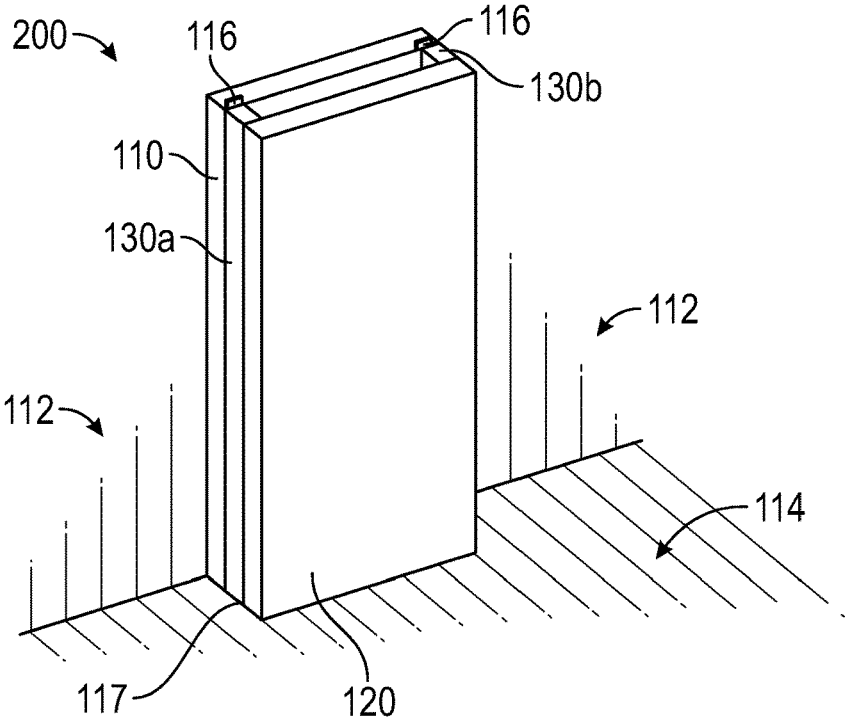
FIG. 2 illustrates the convertible trellis clothesline of FIG. 1 in a fully closed configuration.
Figure 3:
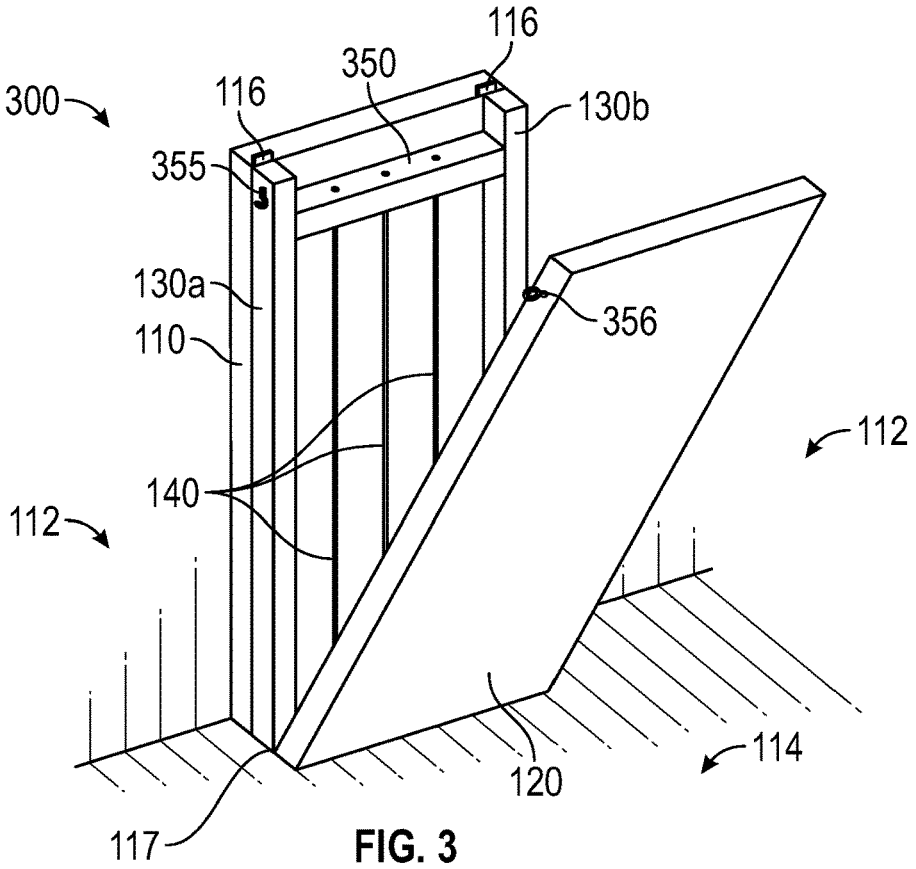
FIG. 3 illustrates the convertible trellis clothesline of FIGS. 1 & 2 with the movable vertical panel disengaged and moved outward.
Figure 4:
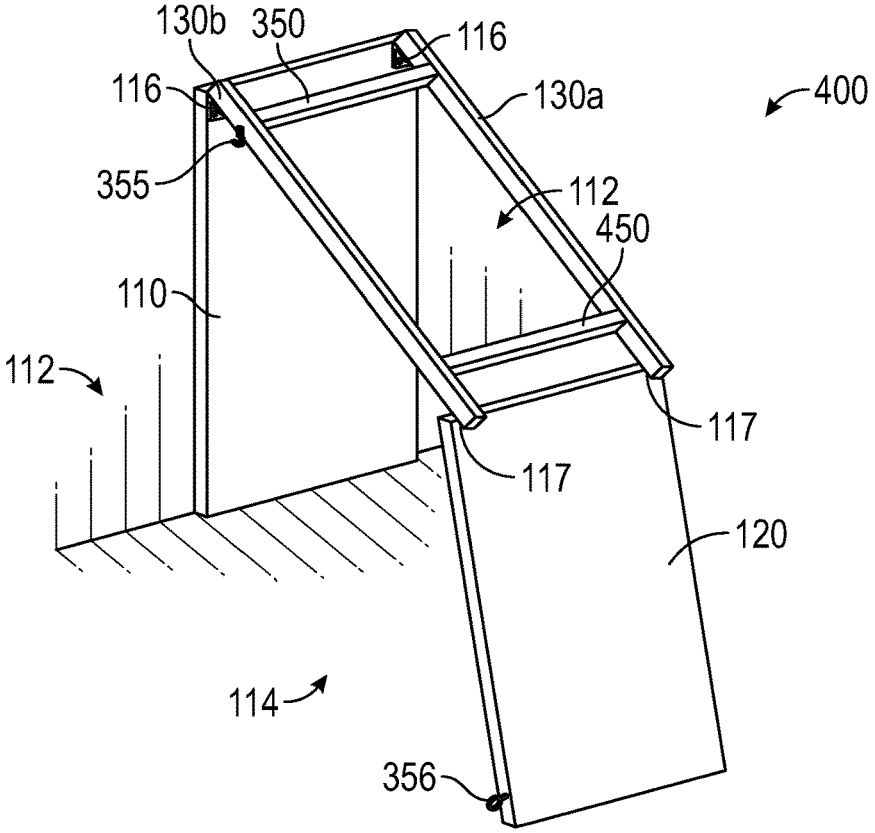
FIG. 4 illustrates another convertible trellis clothesline according to the present inventions with the movable vertical panel and the clothesline section moved away from the vertical support.

FIG. 2 illustrates the convertible trellis clothesline 200 in a fully closed configuration. FIGS. 3 and 4 illustrate the convertible trellis clothesline 100 at some of the points it may go through in the process of expanding the convertible trellis clothesline 100 from the fully closed configuration of FIG. 2 to the fully opened configuration of FIG. 1.

FIG. 2 shows the obverse face of the outer panel 120. The outer panel 120 may be seen in FIG. 2 as sandwiching the beams 130*a*, 130*b* with the first panel 110. That is to say that the first panel 110 is secured to the stationary vertical surface 112, with the beams 130*a*, 130*b* connected to it with hinges 116 (where only the knuckles are visible in this illustration), which are then abutted by the outer panel 120.

Those ordinarily skilled in the art will recognize that the first panel 110 and the outer panel 120 may be constructed such that the beams 130*a*, 130*b* may be recessed within the first panel 110 and the outer panel 120, thus presenting less width from the stationary vertical surface 112.

As was noted, the outer panel 120 may be rotatably secured to the beams 130*a*, 130*b*. In FIG. 2, the mechanism to rotatably secure these pieces together is behind and at the bottom of the outer panel 120 and is thus not visible in this illustration. If the outer panel 120 is not otherwise secured it may fall over onto the ground 114.

A latching mechanism or a plurality of locking mechanisms may be utilized to releasably secure the convertible trellis clothesline 200 together. The latching mechanism (not shown in FIG. 2) may be any of, but not limited to: a hasp; a clasp; a hook and eye latch; magnets; woven hook and loop fasteners; hold-down fasteners; and a loop and hook. In the closed configuration of FIG. 2, the convertible trellis clothesline 200 may be secured into the closed configuration by using any is of these mechanisms or any of a number of others as would be known by those ordinarily skilled in the art by retaining the outer panel 120 with the first panel 110, or by retaining the outer panel 120 to the beams 130*a*, 130*b*, or by retaining the outer panel 120 directly to the stationary vertical surface 112.

FIG. 3 illustrates the convertible trellis clothesline 300 with the outer panel 120 disengaged and tilted outward. This is one of many ways that may start the process of opening the convertible trellis clothesline 300. Ways other than those illustrated in this, and the following figures do not depart from the inventions disclosed herein and will be apparent to those in possession of the disclosures and teachings in this disclosure.

In FIG. 3, the outer panel 120 has been released from its upright position and tilted outwards. In this exemplary embodiment, the mechanism for securing the outer panel 120 is a hook 355 and eye 356 latch. The hook 355 is illustrated as being secured to the beam 130*a*, however, those of ordinary skill in the art will be able to see that a hook could work just as effectively if it were secured to the first panel 110, or the stationary vertical surface 112, or any other support such as a stanchion, post, or baluster.

In this exemplary embodiment, a stretcher 350 spans the distance between the beams 130*a*, 130*b*. In one of many possible embodiments, the clothes hanging lines 140 may be secured to the stretcher 350 by running each through separate holes in the stretcher 350 and tying them off. Mechanisms may be utilized to modify the tension of the clothes hanging lines 140 without departing from the inventions disclosed herein. One such way would be for the stretchers to rotate along their long axis with a mechanism to retain a position, such as a ratchet and pawl. Another is way would be to have a mechanism, such as a spring or by tightening threadable members, to pull the stretcher 350 towards its adjacent end. Those of ordinary skill in the art will be able to envision other mechanisms to tension the clothes hanging lines 140.

FIG. 4 shows the convertible trellis clothesline 400 with the outer, deployable panel 120 rotated further and the beams or rails 130*a*, 130*b* further separated from the first panel 110. For clarity, the clothes hanging lines have not been included in this figure. As was noted before, the clothes hanging lines may extend from the stretcher 350 (as shown in FIG. 2) to the stretcher 450, or from the stretcher 350 to the panel 120, or any number of other configurations as may be devised by those benefitting from the inventions disclosed and taught herein.

As those of ordinary skill in the art may know, handles may be added to any or all of the parts of the convertible trellis clothesline 400 to aid in the expansion or collapsing movements.

Figure 5:
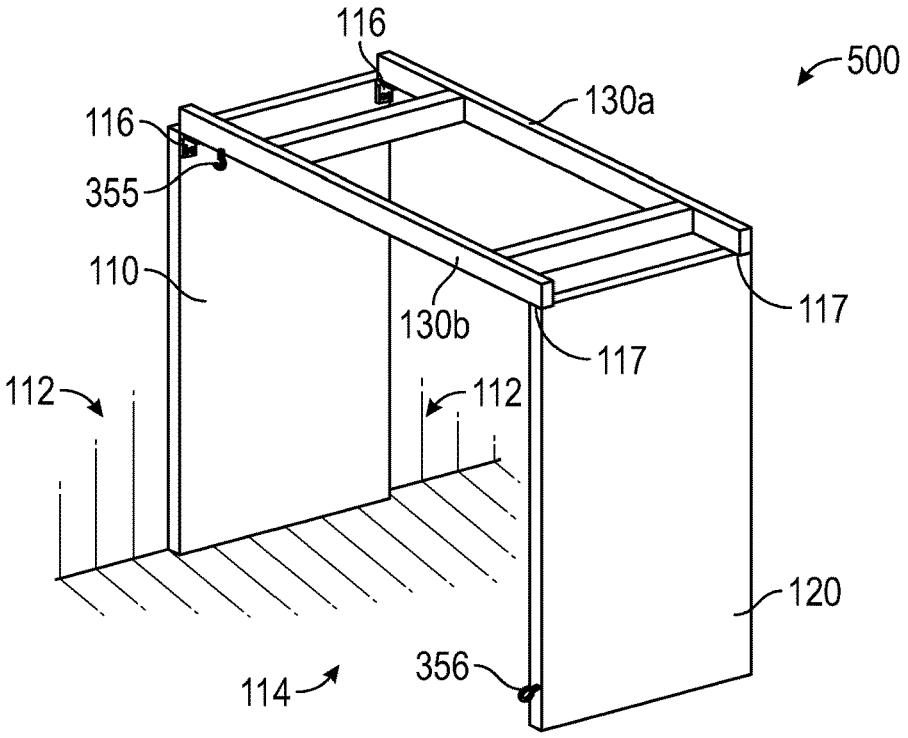
FIG. 5, illustrates the convertible trellis clothesline of FIG. 4 with the movable vertical panel rotating around its attachment to the clothesline section.

FIG. 5 shows the convertible trellis clothesline 500 in a fully extended configuration. Again, for clarity, the clothes hanging lines have not been included in this figure. Note the reverse face of the outer panel 120 is now outwardly facing and is now upside down from its orientation in FIG. 2. This may be seen by the relative location of the hook 355 and eye 356 portions of the latch.

In the fully extended configuration of FIG. 5, the clothes hanging lines 140 must be capable of supporting wet laundry. Similarly, the beams 130*a*, 130*b*, the outer panel 120, and the anchor to the stationary vertical surface 112 must have sufficient strength to react the load of the wet laundry. This must still be the case if the wet laundry is not evenly loaded onto the clothes hanging lines.

Figure 6A:
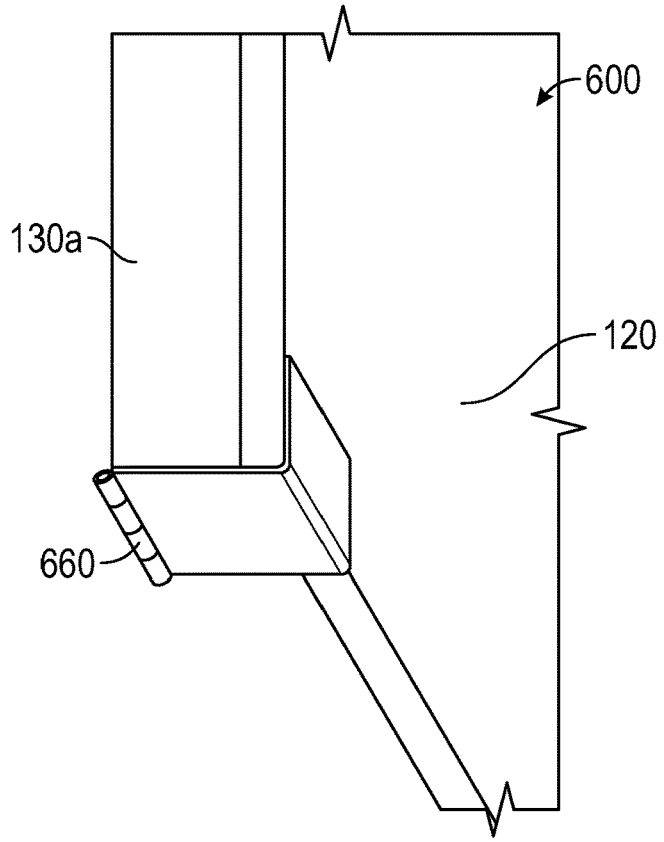
FIGS. 6A and 6B illustrate a hinged portion of the convertible trellis clothesline.
Figure 6B:
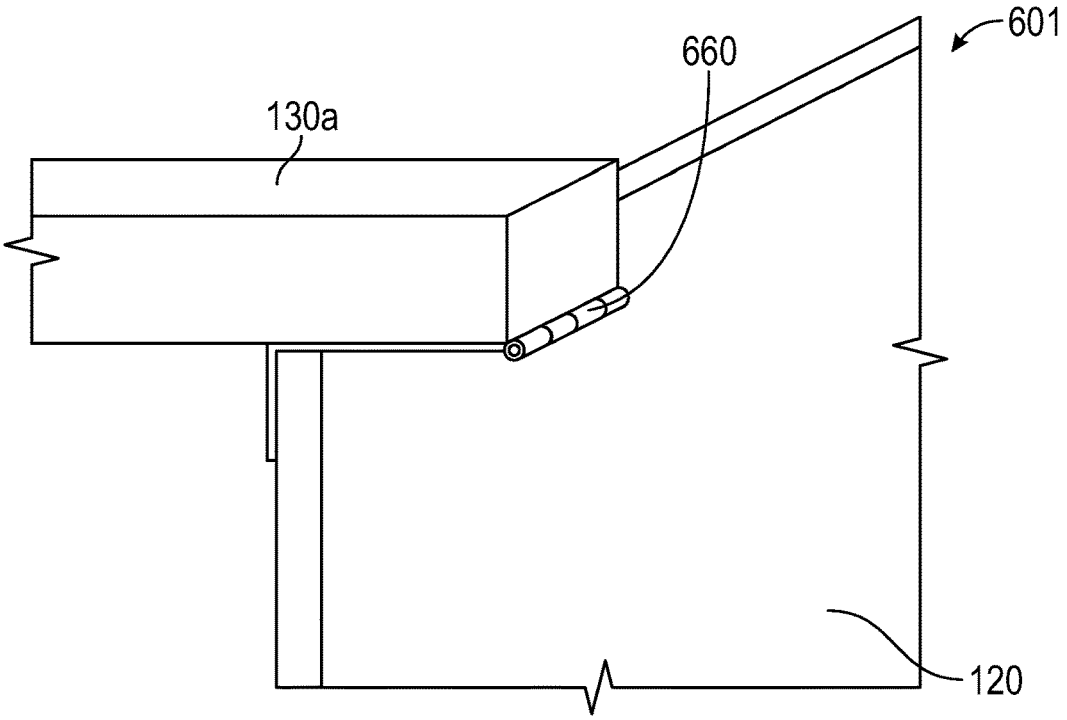

FIGS. 6A and 6B show one of many possible types of hinges 660 that may be used to rotationally secure the beams 130*a*, 130*b* to the outer panel 120 such that the beams 130*a*, 130*b* rest upon the upper end of the outer panel 120 when the convertible trellis clothesline 500 is fully extended as is illustrated in FIG. 5. FIG. 6A illustrates the hinge 660 when the beam 130*a* and the outer panel 120 are parallel to each other 600 such as they would be oriented in FIG. 2 showing the convertible trellis clothesline 200 in the closed configuration. FIG. 6B illustrates the hinge 660 when the beam 130*a* and the outer panel 120 are perpendicular to each other 601 such as when the outer panel 120 has been rotated 270°. This is the orientation of the beam 130*a* and the outer panel 120 when the convertible trellis clothesline is in its fully extended configuration as illustrated in FIG. 5. As illustrated in FIGS. 5 and 6B, the beams 130*a*, 130*b* rest upon the outer panel 120 when the convertible trellis clothesline 500 is in its fully opened configuration. As is noted elsewhere, if the outer panel 120 is not capable of supporting the load from the frame and the wet laundry, other structural members may be added to the outer panel 120 to fully react that load. Those ordinarily skilled in the art may envision and deploy other hinges or rotatable mechanisms that are known in the art without departing from the inventions disclosed and taught herein.

As was noted elsewhere, the beams 130*a*, 130*b* may be anchored to the first panel 110 or to its support, such as a wall, stanchion, bollard, post, or other supporting device. At their other ends, the beams 130*a*, 130*b* may be rotationally fixed to the outer panel 120. If the outer panel 120 is stably fixed in relation to the ground 114, ordinary hinges may be used to secure the outer panel 120 to the beams 130*a*, 130*b*. However, if the outer panel 120 is not capable of being stably fixed in relation to the ground 114, other mechanism may be used to prevent or suppress rotational movement of the outer panel 120 relative to the beams 130*a*, 130*b*. Those of ordinary skill in the is art may be aware that such mechanisms include but are not limited to: locking hinges; gussets that may be removably secured to one or both beams 130*a*, 130*b* and the outer panel 120; removable dowels or pins retaining the outer panel 120 in a relatively stable orientation to the beams 130*a*, 130*b*; and removable braces.

In a preferred embodiment, the convertible trellis clothesline 500 secured with any of the mechanisms described will be able to remain in the fully extended configuration even when fully loaded with wet laundry and not yield to forces exerted by gusts of wind; children and/or pets bumping the outer panel 120; and/or any other force that may react the outer panel 120.

A preferred embodiment of the convertible trellis clothesline 500 may utilize lockable hinges that may swing freely up to the point where the beams 130*a*, 130*b* are at an angle of 90° to the outer panel 120 such that the outer panel 120 is substantially upright when it is contacting the ground and when the beams 130*a*, 130*b* are substantially horizontal. At that point, the locking hinges may automatically lock in position. This may be advantageous to the user in that the locking hinges may lock at a desirable angle securing the outer panel 120 to the beams 130*a*, 130*b* and where the other ends of the beams 130*a*, 130*b* are still rotationally secured to an anchor point on the inner panel 110. This may allow the user to have the beams 130*a*, 130*b* and the outer panel 120 locked in position before placing the end of the outer panel 120 on the ground 114.

When the user desires the convertible trellis clothesline 500 to be collapsed, the user may unlock the hinges while slightly raising the outer panel 120 above the ground and shifting the lower end of the outer panel 120 rotationally away from the first panel 110.

The preferred materials to be used in the construction of the framework of the convertible trellis clothesline 500 are envisioned to be comprised of wood and wood products, such as but not is limited to plywood and bamboo, aluminum, steel, plastics, and/or composites. A preferred embodiment may comprise sturdy but lightweight materials such as, but not limited to thin plywood, bamboo, or aluminum for the first panel 110; sturdy hardwood, aluminum, or steel beams 130*a*, 130*b*; and an outer panel 120 of either thin plywood, bamboo, aluminum, plastic or a relatively inflexible lattice. The lattice may be a thin lattice supported in a variety of ways by articles such as but not limited to tubulars and angle iron that will support the load of the beams 130*a*, 130*b* and the wet laundry. The materials to be used in the construction of the framework should also be capable of withstanding the elements. The materials may be weatherproofed by painting, sealing, coating, treating, or by other methods known to those ordinarily skilled in the art.

If a lattice or other article is used for the outer panel 120 that does provide visibility of the inner panel 110 or the vertical support surface 112, then the clothes hanging lines 140 may also be visible when the convertible trellis clothesline is in its fully collapsed configuration. If the user does not wish to see the clothes hanging lines 140 in this configuration, the clothes hanging lines 140 may be hidden by any number of methods including but not limited to placing a macrame or other hanging over the outer panel 120. Therefore, the use of any material for the outer panel 120 may still fully or partially conceal the clothes hanging lines 140 and the inner panel 110 or the vertical support surface 112.

Those benefitting from the inventions and teachings disclosed herein will understand that an objective is to provide a convertible trellis clothesline that may be collapsed and extended by those of ordinary strength. To achieve this goal, other materials may be used, or other configurations may be designed and deployed that still adhere to the inventions and teachings is disclosed herein.

Figure 7:
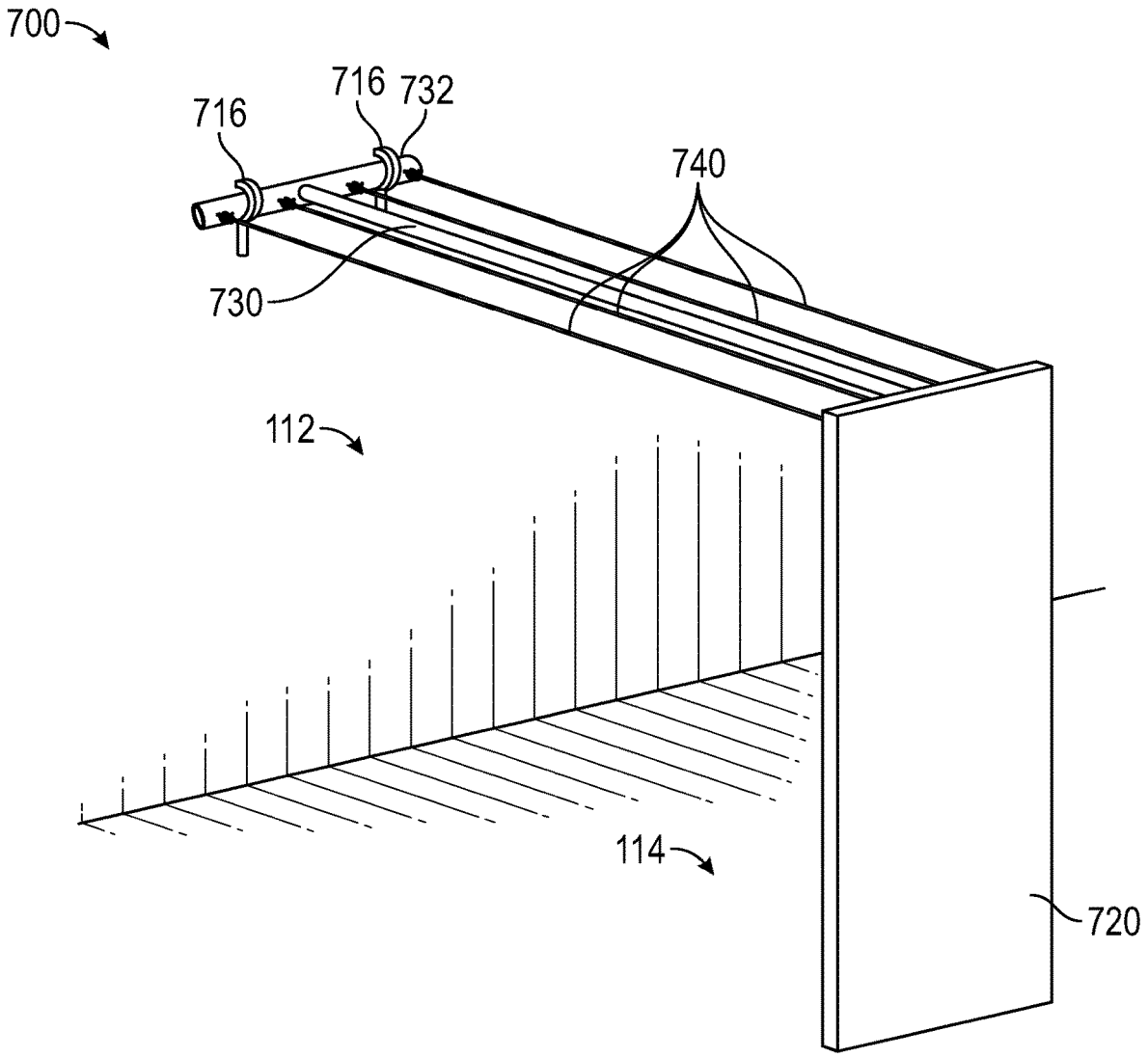
FIG. 7 illustrates another embodiment of a deployable trellis clothesline in a fully expanded configuration.

FIG. 7 illustrates an alternative embodiment where the frame of the rails and stretchers that was illustrated in FIGS. 1-5 have been replaced by a single beam or rail 730 and where there is no panel attached to the vertical surface 712. FIG. 7 illustrates the convertible trellis clothesline 700 in a fully extended configuration. The convertible trellis clothesline 700 may be expanded and collapsed by a user in the manner associated with FIGS. 2-5.

While a single hinge may be used at each end of the single rail 730 to connect to an anchor on the vertical surface 12 and the outer panel 720, other configurations may provide the same results and adhere to the teachings and inventions disclosed herein.

In the illustrated embodiment of FIG. 7 the anchor comprises hanging hooks 716 and the rail 730 further comprises a crossbar 732 configured to rotatably fit within the hanging hooks 716. The crossbar 732 may also be used to secure the clothes hanging lines 740. This embodiment may allow the rail 730 and the outer panel 720 to be removed if that is desired by the user. In this embodiment, the rail 730 and crossbar 732 may be made from metal or sturdy plastic pipe to ensure sufficient rigidity as well as light weight.

Figure 8:
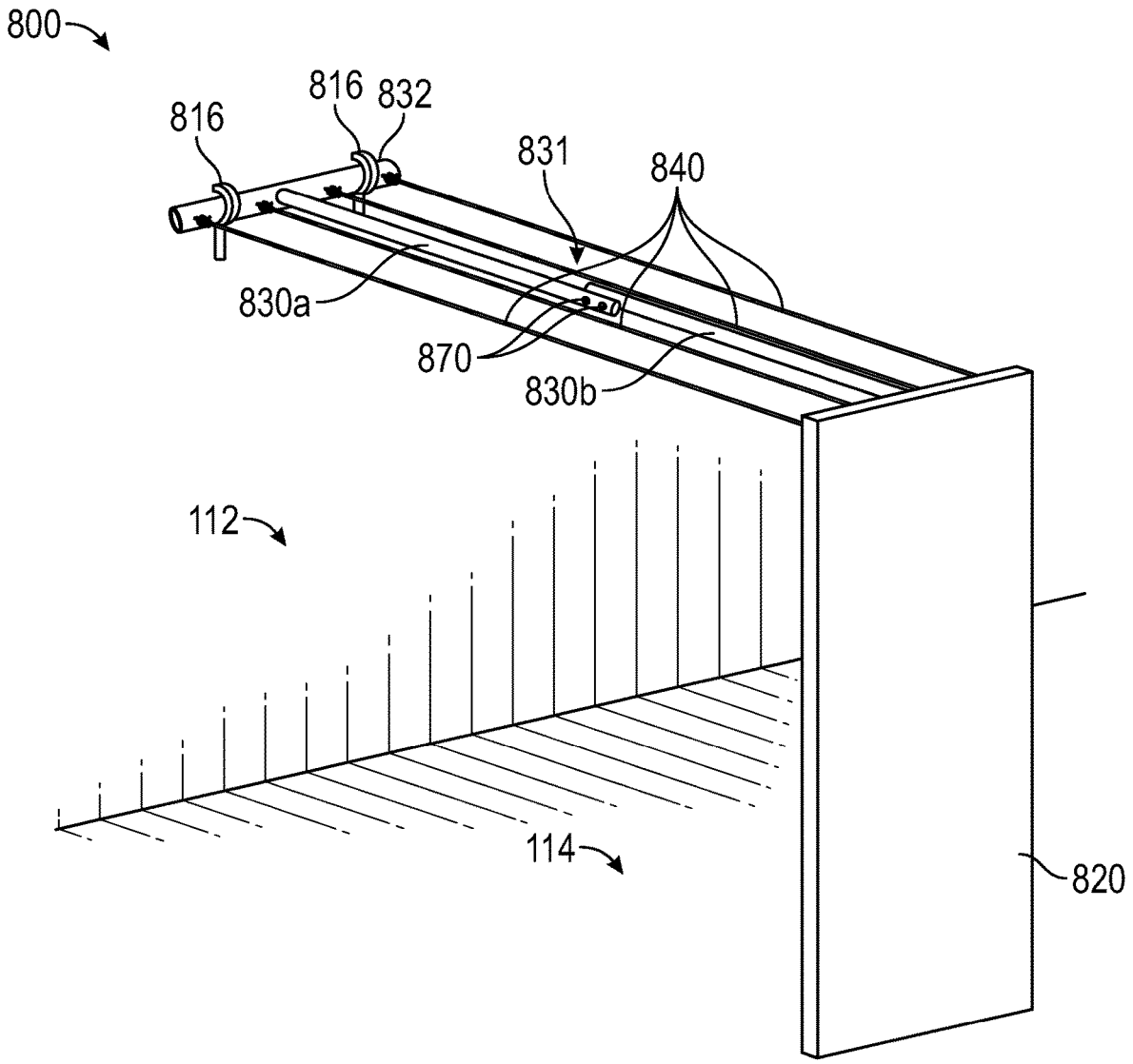
FIG. 8 illustrates yet another embodiment of a deployable trellis clothesline having two clothes hanging sections in a fully expanded configuration.

FIG. 8 illustrates an alternative embodiment of the convertible trellis clothesline 800 comprising segmented portions 830*a*, 830*b* with a crossbar 832. In this envisioned embodiment, the obverse face of the panel 820 will face outwards in both the collapsed configuration as well as in the fully extended or deployed configuration. As shown in FIG. 8, the rail or beam segments 830*a*, 830*b* may be placed side-by-side so that they are next to each other when the convertible trellis clothesline 800 is in its collapsed configuration. Once unfolded or deployed, the rail segments 830*a*, 830*b* may be secured together so they may react the weight of the wet laundry and any movement of the outer panel without swaying or bowing. While the two segments 830*a*, 830*b* need not be as long as the panel 820, if they are then the overall span of the clothes hanging lines 840 will be approximately twice as long as the panel 820.

The segments 830*a*, 830*b* may be releasably secured together with threadable members through the segments 830*a*, 830*b*, or by securing them together in any other way that is known to those ordinarily skilled in the art. One of many possible ways to accomplish this may be to use two bolts 870 driven through both segments 830*a*, 830*b* at a distance apart that will prevent relative rotation. Removing either bolt 870 will allow the segments 830*a*, 830*b* to rotate relative to each other so that the convertible trellis clothesline 800 may be collapsed by moving the panel 820 towards the vertical support surface 812.

An additional mechanism to support the segments 830*a*, 830*b* at the joint 831 between them may be to rotatably secure a rod that may span the distance from the joint 831 to the ground 814. The rod (not shown in this illustration) may be extended when the convertible trellis clothesline 800 is extended and collapsed to fit between the panel 820 and the vertical support surface 812 (or a first panel if desired) when the convertible trellis clothesline 800 is collapsed.

Other and further embodiments utilizing one or more aspects of the inventions described above can be devised without departing from the spirit of Applicant's invention. Further, the various methods and embodiments of the methods of manufacture and assembly of the system, as well as location specifications, can be included in combination with each other to produce variations of the disclosed methods and embodiments. Discussion of singular elements can include is plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements that come within the scope or range of equivalent of the following claims.

What is claimed is:

1. A decorative outdoor assembly that deploys into a clothes drying structure, the assembly comprising:

a first panel comprising a first end and a second end with a first length between the ends, wherein the second end is rotatably affixed to a first end of a first rail;

the first rail having a first rail end and a second rail end, and wherein the second rail end is rotatably connected to an anchor;

the anchor comprising an axis of rotation positioned substantially at the first length above ground;

wherein a closed configuration comprises the first end of the first panel is disposed adjacent the anchor and the second end of the first panel is disposed adjacent the ground, with the first rail is disposed in a vertical position between the first panel and the anchor;

wherein an opened configuration comprises the first rail in a substantially horizontal position between the anchor and the second end of the first panel; and wherein at least one clothesline is secured to the assembly between the first panel and the anchor when the assembly is in the opened configuration.

2. The assembly of claim 1, wherein the first end of the first panel is adjacent the ground in the opened configuration.

3. The assembly of claim 1, wherein the anchor is secured to a freestanding vertical structure.

4. The assembly of claim 1, wherein the anchor further comprises at least one vertical panel.

5. The assembly of claim 4, wherein the vertical panel further comprises at least one face.

6. The assembly of claim 4, wherein a first end of the clothesline is secured to the vertical panel.

7. The assembly of claim 6, wherein the second end of the clothesline is secured to the first panel.

8. The assembly of claim 1, further comprising a second rail spaced apart from the first rail, the second rail comprising first and second rail ends, and wherein the at least one clothesline is disposed in a plane defined by the first and second rails.

9. The assembly of claim 8, wherein the first and second rails further comprise at least one hinge between the first ends of the first and second rails and the second end of the first panel.

10. A retractable clothesline system comprising:

a first support rotatably secured to a first end of a rail;

a second end of the rail rotatably secured to a panel;

wherein the panel is movable from a first position separated from the first support by the rail in a substantially horizontal position to a second position where the panel is adjacent the first support and the rail is in a substantially vertical position between the panel and the first support; and wherein at least one clothes hanging line spans between the first support and the panel.

11. The system of claim 10, wherein the first support comprises a first hinge that connects to the first end of the rail and has at least one lockable position; and wherein the panel comprises a second hinge that connects to the second end of the rail and has at least one lockable position.

12. The system of claim 11, wherein the first support is secured to a freestanding vertical structure.

13. The system of claim 11, wherein the first support further comprises a wall.

14. The system of claim 11, wherein the rail comprises a frame with outer edges, and wherein the at least one clothes hanging line is secured to opposing outer edges.

15. The system of claim 11, wherein the rail comprises jointed segments and wherein the jointed segments are configured to be linked together in a lockable position.

16. The system of claim 15, wherein the rail further comprises at least one arm emanating away from a central axis.

17. A trellis that converts to a garment hanging system, comprising:

a first hinge configured to rotatably secure a frame to a stationary vertical support, the first hinge oriented at a first distance above ground;

the frame configured to secure at least one article hanging line from a first point proximal to the vertical support on the frame to a second point distal to the vertical support on the frame;

the frame further configured to be rotatably connected to a movable vertical support, where the movable vertical support has a height of substantially the first distance;

the movable vertical support having a first position in which the frame is vertically disposed between the stationary vertical support and the movable vertical support, and having a second position in which the frame is horizontally disposed between the stationary vertical support and the movable vertical support.

18. The trellis of claim 17, where the stationary vertical support is a wall.

19. The trellis of claim 17, where the frame comprises a jointed member.

20. The trellis of claim 17, where the frame comprises a telescoping member.

* * * * *